US006364109B1

(12) United States Patent
Blackwell

(10) Patent No.: US 6,364,109 B1
(45) Date of Patent: Apr. 2, 2002

(54) SOCKET HOLDER

(76) Inventor: John H. Blackwell, 3245 Barrancas Ave., Pensacola, FL (US) 32507

( * ) Notice: Subject to any disclaimer, the term of this patent is extended or adjusted under 35 U.S.C. 154(b) by 0 days.

(21) Appl. No.: 09/652,845

(22) Filed: Aug. 31, 2000

(51) Int. Cl.[7] ..... B65D 85/20
(52) U.S. Cl. ..... 206/378; 211/70.6
(58) Field of Search ..... 206/349, 372, 206/373, 378, 493

(56) References Cited

U.S. PATENT DOCUMENTS 5,560,480 A 10/1996 Singleton ..... 206/373
6,079,559 A * 6/2000 Lee ..... 206/378
6,092,655 A * 7/2000 Ernst ..... 206/378
6,092,656 A * 7/2000 Ernst ..... 206/378
6,098,799 A * 8/2000 Lee ..... 206/378

* cited by examiner

*Primary Examiner*—David T. Fidei
(74) *Attorney, Agent, or Firm*—Peter Loffler

(57) ABSTRACT

A socket holder holds sockets firmly in place without the need for a lid. Sockets can be extracted from and returned to the socket holder without undue effort. The socket holder has a base and a wall with a channel disposed in the base. A post is attached to the wall and extends into the channel. A pocket is disposed within the base while a slot extends between the pocket and the channel. A retaining member slides within the channel and the pocket and has a leg with a rounded surface. A spring resides in the pocket and abuts a wall of the pocket and a portion of the retaining member.

14 Claims, 3 Drawing Sheets

SOCKET HOLDER

BACKGROUND OF THE INVENTION

1. Field of the Invention

The present invention relates to a portable holder for holding and retaining sockets.

2. Background of the Prior Art

Socket holders come in many varieties from the very simple to the outright complex. One feature that many users desire with a socket holder is the ability to quickly and easily transport the holder and the sockets held by the holder without spilling or otherwise displacing the sockets. One of the most popular methods used to achieve this goal is to provide the holder with a lid wherein the lid is closed for holder and socket transport. In many cases, such a holder is very efficient, although it does have drawbacks. Each time the holder is to be moved, the lid must be closed (and probably latched) and thereafter reopened for socket usage. Such closing and opening cycles can be very inefficient to a mechanic who frequently moves from one work spot to another. Additionally, such holders need to be opened on a surface that is relatively flat in order to prevent the sockets from spilling out. If an open holder is knocked over, the sockets will spill out. Even if a socket holder is closed, the sockets can still spill out in a knock over if the latching mechanism used to hold the lid closed is not very sturdy.

In order to overcome such limitations, devices have been proposed that hold each socket firm even if the lid is open. However, such devices are either unduly complex in design or require a relatively large amount of time to remove a socket from the device and to return a socket into position within the device.

Therefore, there is a need in the art for a device that holds sockets firmly in place without the need for a lid that opens and closes the device. The device must hold the sockets in an accessible orientation, irrespective of the position of the device. Such a socket holder must be of relatively simple design and construction and each socket must be easily extracted from and returned to the socket holder without an undue expenditure of time.

SUMMARY OF THE INVENTION

The socket holder of the present invention addresses the aforementioned needs in the art. The socket holder holds sockets firmly in place without relying on a lid. The socket holder can be in any position and still hold the sockets in place with the ability to extract a socket therefrom. The socket holder is of relatively simple design and construction and allows a socket to be extracted therefrom and properly returned back thereinto without an undue expenditure of time.

The socket holder of the present invention is comprised of a base having first side, a second side, and a medial portion. A center wall extends along the medial portion of the base while an open generally concave channel is disposed on the medial portion of the base and extends outwardly from the wall toward the first side. A post is attached to the center wall and extends into the channel. A pocket is disposed within the base proximate the first side. A slot is disposed within the base and extends between the pocket and the channel. A retaining member has a first end slidably disposed within the slot and a second end slidably disposed within the pocket. The retaining member has a first leg, which has a rounded surface, and a second leg connected by a third leg and is made from or coated with a nonmetallic material such as nylon, plastic, rubber, neoprene, etc. A spring has a third end abutting a wall, either an inner wall or the outer wall, of the pocket and a fourth end abutting a portion of the retaining member. A carrying handle is removably attached to the base.

A socket is placed into the socket holder by retracting the retaining member toward the side of the base and placing a socket into the channel such that the post is received within the ratchet opening of the socket. The retaining member, via the action of the spring, is allowed to return to the extended position wherein the second leg of the retaining member abuts the lip of the socket and the rounded surface of the retaining member grasps a portion of the inner face of the socket thereby holding the socket firmly in place.

BRIEF DESCRIPTION OF THE DRAWINGS

Similar reference numerals refer to similar parts throughout the several views of the drawings.

DESCRIPTION OF THE PREFERRED EMBODIMENT

Figure 1:
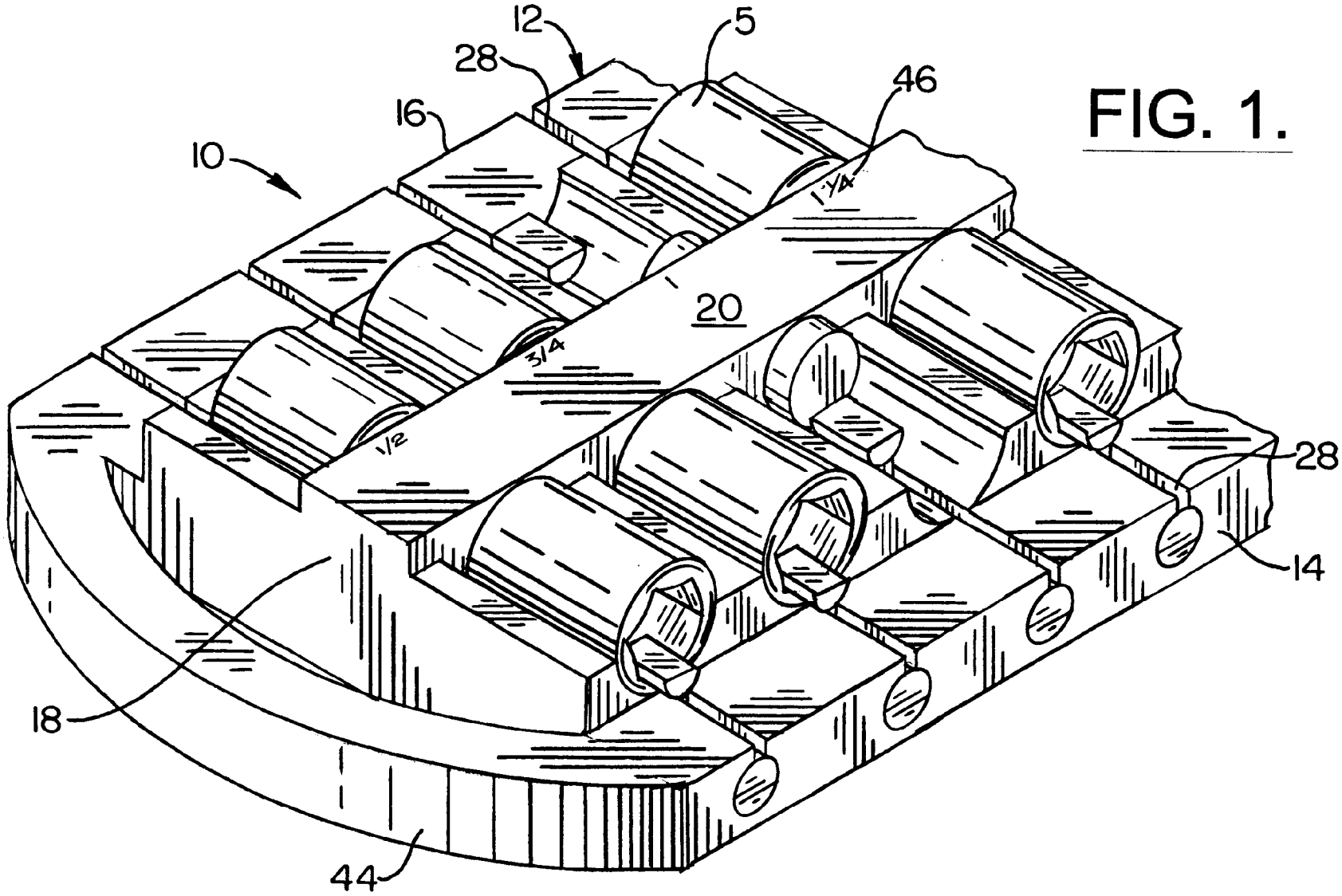
FIG. 1 is a perspective view of a portion of the socket holder of the present invention.
Figure 2:
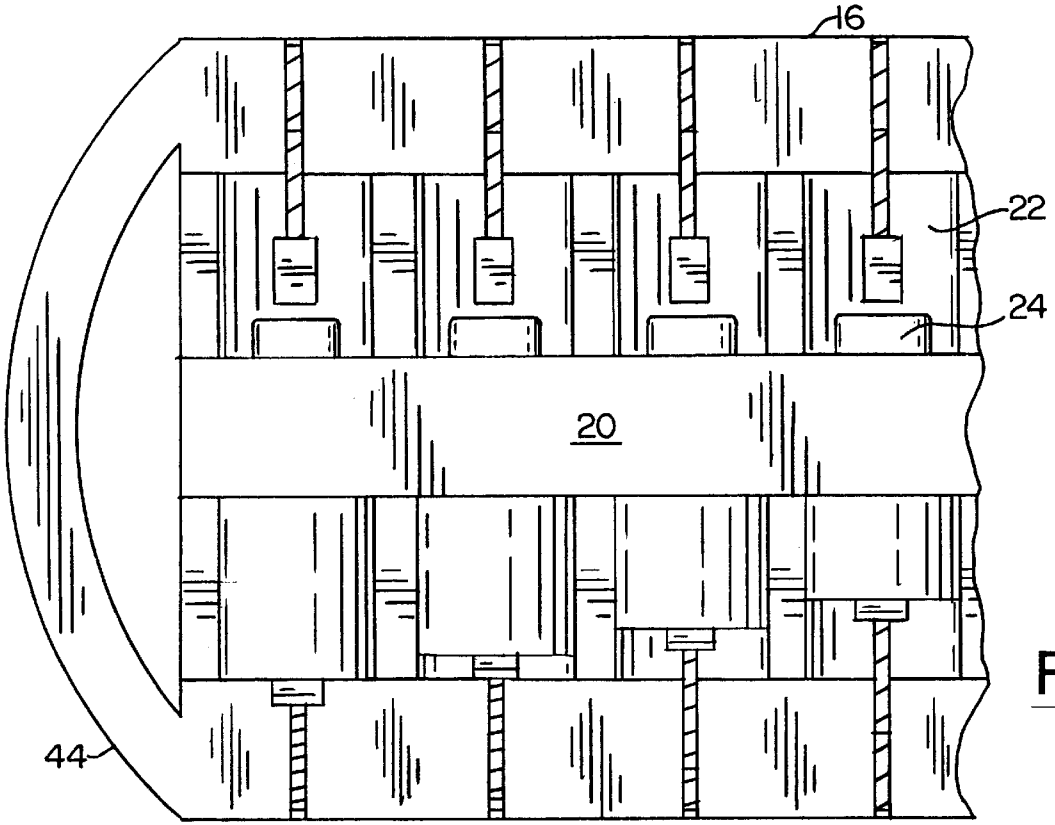
FIG. 2 is a top plan view of a portion of the socket holder of the present invention.
Figure 3:
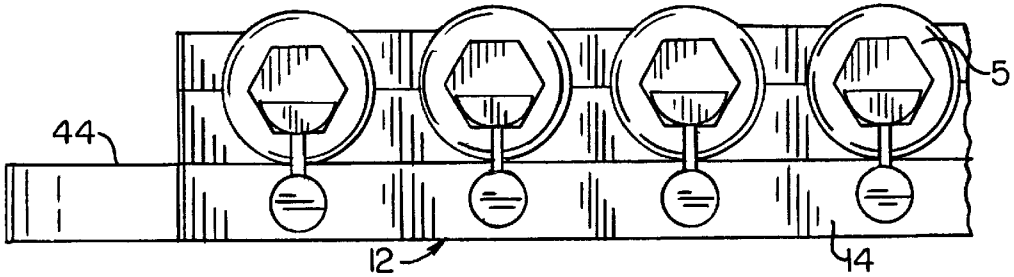
FIG. 3 is a side view of a portion of the socket holder of the present invention.
Figure 4:
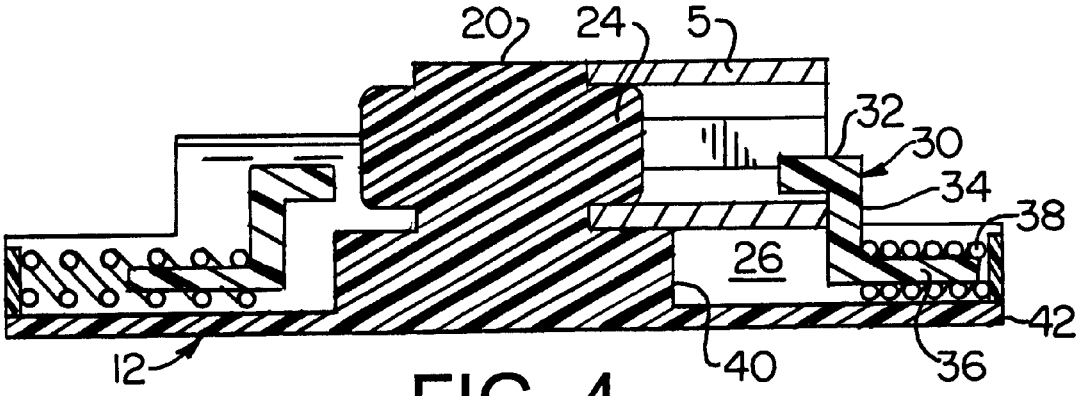
FIG. 4 is a sectioned view of the socket holder of the present invention.

Referring now to the drawings, it is seen that the socket holder of the present invention, generally denoted by reference numeral 10, is comprised of a base 12 having first side 14, a second side 16, and a medial portion 18. A center wall 20 extends along the medial portion 18 of the base 12. At least one socket retainer is provided and each is comprised of an open generally concave channel 22 disposed on the medial portion 18 of the base 12 and extending outwardly from the center wall 20 toward the one of the sides 14 or 16. A post 24 having a generally round shape to correspond to the narrow point of a ratchet end of a socket S, which allows the socket S to rotate, and which may have a receiving hole to receive Allen, Torx, and Bit type sockets, is attached to the center wall 20 and extends into the channel 22. A pocket 26 is disposed within the base 12 proximate one of the sides 14 or 16. A slot 28 is disposed within the base 12 and extends between the pocket 26 and the channel 22. A retaining member 30 has a first end slidably disposed within the channel 22 and a second end slidably disposed within the pocket 26. The retaining member 30 has a first leg 32 and a second leg 34 connected by a third leg 36. A surface of the first leg 32 (the first end) of the retaining member 30 is rounded. The retaining member 30 is made entirely from a nonmetallic material such as nylon, plastic, neoprene, etc., or is coated with such a material. A spring 38 is disposed within the pocket 26 and encompasses the second leg 34 of the retaining member 30. The spring 38 has a third end abutting a wall—either an inner wall 40 or an outer wall 42—of the pocket 26 and a fourth end abutting a portion of the retaining member 30, namely the third leg 36. The spring 38 holds the retaining member 30 in a normally extended position wherein the retaining member 30 is located relatively closer to the wall 40 or 42. When a force is placed on the retaining member 30, the retaining member 30 slides within the slot 28 and the pocket 26 to a retracted position toward its respective side 14 or 16 of the base 12. The spring 38 also prevents the retaining member 30 from being extracted from the slot 28 and from the pocket 26. The spring 38 may abut the outer side wall 42 of the pocket 26 such that it compresses whenever the retaining member 30 is slid to the retracted position, as illustrated in FIG. 4, or the orientation of the third leg 36 may be reversed and the spring 38 is secured to an inner side wall 40 of the pocket 28 such that the spring 38 extends whenever the retaining member 30 is slid to the retracted position. A similar retainer can be provided on the top of the center wall 20 in order to hold extensions.

A carrying handle 44 is attached, fixedly or removably, to the base 12 at any appropriate point such as at an end of the base 12. Appropriate size markings 46 can be placed on the center wall 20 at each socket retainer in order to allow a user to place each socket S into its proper place.

In order to use the socket holder 10 of the present invention, a socket S is placed into a socket retainer by retracting the retaining member 30 toward its respective side 14 or 16 of the base 12. The socket S is placed into the channel 22 such that the post 24 is received within the ratchet opening of the socket S. The retaining member 30, via the loading of the spring 38, is allowed to return to the extended position wherein the second leg 34 of the retaining member 30 abuts the lip of the socket S and the rounded first end of the retaining member 30 grasps a portion of the inner face of the socket S thereby holding the socket S firmly in place. As the retaining member 30 is made entirely from or coated with an appropriate nonmetallic material, the retaining member 30 will not scuff or scratch the socket S.

Each base 12 may be designed so as to be stackable and have magnets on the underside in order to be removably attached to a metal surface for easy access to the device 10.

While the invention has been particularly shown and described with reference to an embodiment thereof, it will be appreciated by those skilled in the art that various changes in form and detail may be made without departing from the spirit and scope of the invention.

I claim:

1. A socket holder comprising:

a base having a wall;

a pocket disposed within the base;

a channel disposed within the base;

a post attached to the wall of the base and extending into the channel;

a slot disposed within the base and extending from the pocket to the channel;

a retaining member having a first end slidably disposed within the slot and a second end slidably disposed within the pocket; and a spring having a third end abutting a wall of the pocket and a fourth end abutting a portion of the retaining member.

2. The socket holder as in claim 1 wherein the retaining member has a first leg, a second leg, and a third leg connecting the first leg and the second leg.

3. The socket holder as in claim 2 wherein the spring encompasses the second leg and the fourth end of the spring abuts the third leg.

4. The socket holder as in claim 1 wherein the retaining member is made from a nonmetallic material.

5. The socket holder as in claim 1 wherein the retaining member is made from nylon.

6. The socket holder as in claim 1 wherein a surface of the first end of the retaining member is rounded.

7. The socket holder as in claim 1 further comprising a handle attached to the base.

8. A socket holder comprising:

a base having first side, a second side, and a medial portion;

a wall attached to the medial portion of the base;

an open channel disposed on the medial portion of the base and extending outwardly from the wall toward the first side;

a post attached to the wall and extending into the channel;

a pocket disposed within the base proximate the first side;

a slot disposed within the base and extending from the pocket to the channel;

a retaining member having a first end slidably disposed within the slot and a second end slidably disposed within the pocket; and a spring having a third end abutting a wall of the pocket and a fourth end abutting a portion of the retaining member.

9. The socket holder as in claim 8 wherein the retaining member has a first leg, a second leg, and a third leg connecting the first leg and the second leg.

10. The socket holder as in claim 9 wherein the spring encompasses the second leg and the second end of the spring abuts the third leg.

11. The socket holder as in claim 8 wherein the retaining member is made from a nonmetallic material.

12. The socket holder as in claim 8 wherein the retaining member is made from nylon.

13. The socket holder as in claim 8 wherein a surface of the first end of the retaining member is rounded.

14. The socket holder as in claim 8 further comprising a handle attached to the base.

* * * * *